United States Patent [19]

Peter

[11] Patent Number: 4,770,213

[45] Date of Patent: Sep. 13, 1988

[54] COUPLING DEVICE FOR COUPLING A HEALD FRAME TO A LIFTER OF A LOOM

[75] Inventor: Hans Peter, Winterthur, Switzerland

[73] Assignee: Sulzer Brothers Limited, Winterthur, Switzerland

[21] Appl. No.: 35,443

[22] Filed: Apr. 7, 1987

[30] Foreign Application Priority Data

Apr. 11, 1986 [CH] Switzerland ..... 01445/86

[51] Int. Cl.[4] ..... D03C 13/00

[52] U.S. Cl. ..... 139/88

[58] Field of Search ..... 139/57, 82, 83, 87, 139/88

[56] References Cited

U.S. PATENT DOCUMENTS 4,378,819 4/1983 Macho ..... 139/88

4,452,282 6/1984 Notter ..... 139/88

FOREIGN PATENT DOCUMENTS 2524013 9/1983 France ..... 139/88

861423 9/1981 U.S.S.R. ..... 139/88

*Primary Examiner*—Henry S. Jaudon

*Attorney, Agent, or Firm*—Kenyon & Kenyon

[57] ABSTRACT

The coupling device has a sleeve formed with a cavity to receive a coupling member of the heald frame. A pair of projections are provided within the sleeve for engaging in mating recesses of the coupling member and widenings are provided in the sleeve to permit pivoting of the sleeve and member relative to each other. When in a coupled state, the projections are engaged within the recesses. When in an uncoupled position, the member is free to be lifted vertically out of the sleeve.

19 Claims, 5 Drawing Sheets

Figures 1, 2A, 2B:
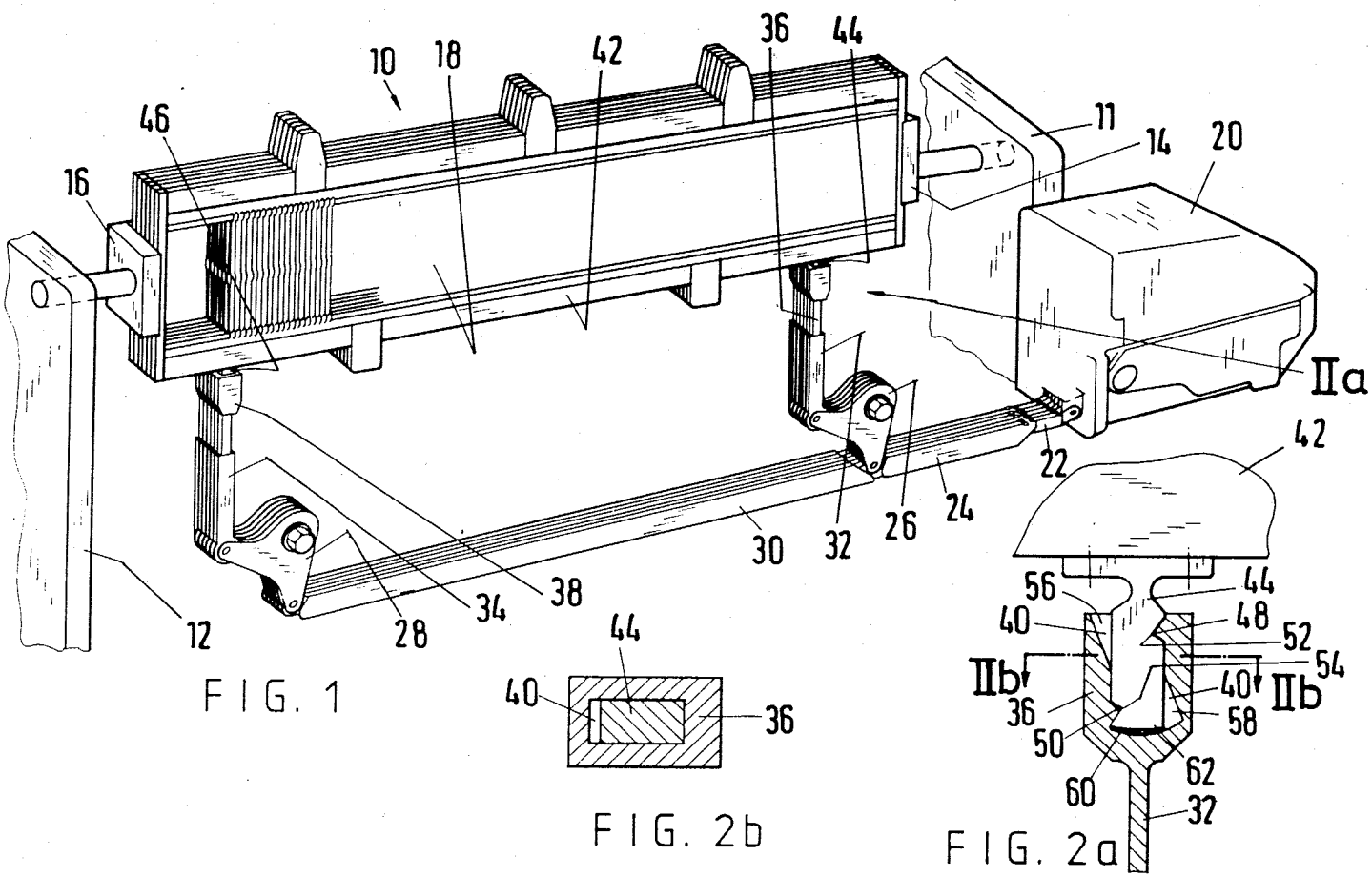

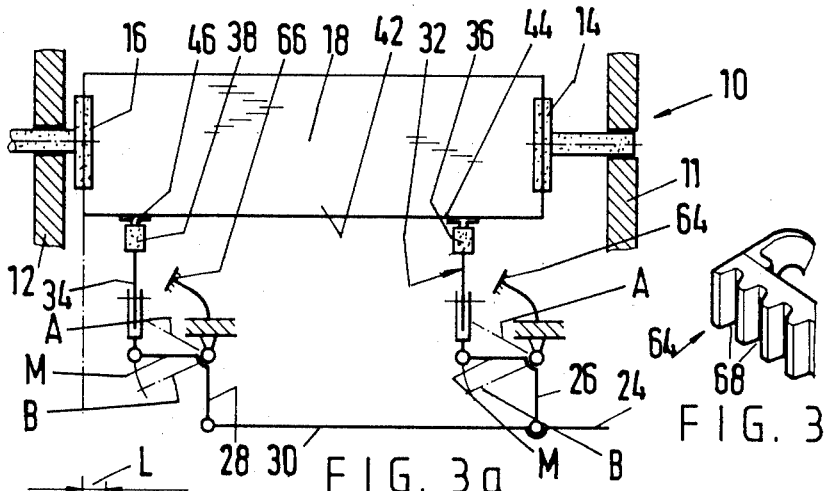
FIG. 3a
FIG. 3b
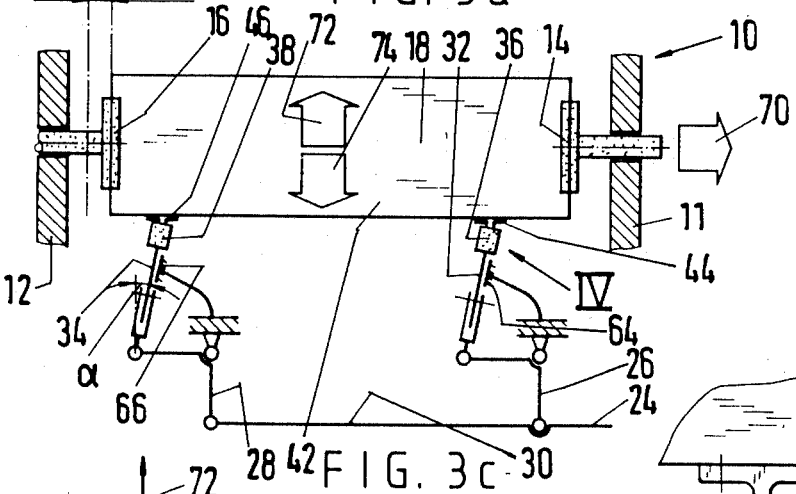
FIG. 3c
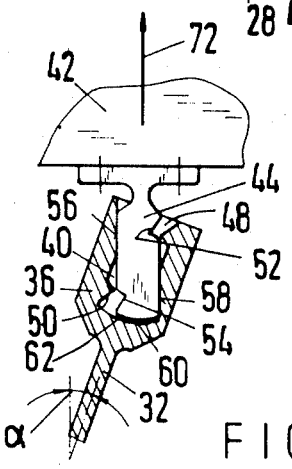
FIG. 4
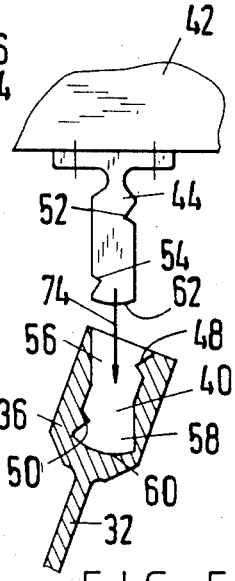
FIG. 5

FIG. 9a
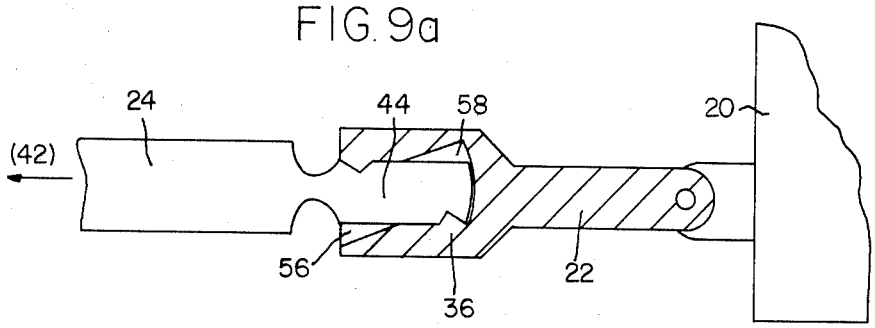
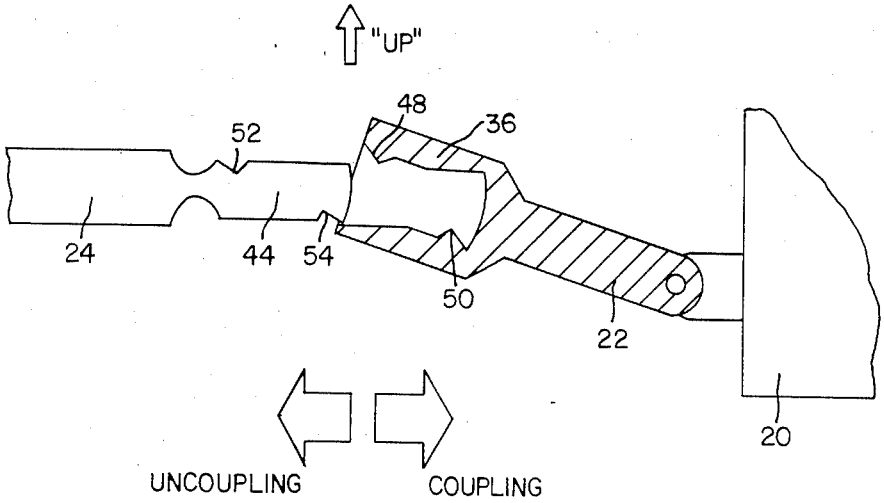
FIG. 9b

COUPLING DEVICE FOR COUPLING A HEALD FRAME TO A LIFTER OF A LOOM

This invention relates to a coupling device.

More particularly, this invention relates to a coupling device for coupling a heald frame to a lifter of a loom or for coupling a heald frame with lifter mechanism to the shedding motion of a loom.

Heretofore, it has been known to connect a heald or heddle frame of a loom or weaving machine to a drive mechanism by which the heald frame can be raised and lowered in a reciprocating manner during operation in accordance with a shedding program. For example, U.S. Pat. No. 3,696,842 describes a coupling device which employs a hook on a drive lifter and a holder on a heald frame for receiving a tooth of the hook. German Pat. No. 3,036,419 (MR174) also describes a coupling device which employs a hook having jaws adapted to receive a correspondingly shaped companion member on a heald frame. In this case, the hook has a bearing surface into which the jaws merge and on which the companion member bears. Further, the hook can be located in a pivoted position in which the companion member can be lowered freely onto the bearirg surface. The German Patent also describes an adjusting element and a displacement element with each of two rows of lifters for use with the coupling device.

As is known, it is necessary from time-to-time to remove or replace heald frames in a loom. However, when such an operation is conducted, it is necessary to uncouple the coupling devices between the lifters and the heald frames. The previously known coupling devices have, however, been relatively complex mechanisms which require time consuming manipulations. Further, the previously known coupling devices have not been particularly suitable for automation of a coupling operation.

Accordingly, it is an object of the invention to provide a relatively simple and reliable coupling device which is suitable for automated operation.

It is another object of the invention to provide a coupling device for coupling a heald frame to one or more lifters which is suitable for automated operation involving the use of robots.

It is another object of the invention to provide a coupling device for a heald frame which can be readily incorporated in existing looms.

Briefly, the invention provides a coupling device for coupling a heald frame to a lifter for raising and lowering the heald frame. This coupling device comprises a coupling sleeve, a coupling member disposed within the sleeve, at least one projection on one of the sleeve and member and a recess in the other of the sleeve and member for receiving the projection. In addition, a pair of widenings is provided in the sleeve on opposite sides of the received member in order to permit relative pivoting of the sleeve and member for engaging and disengaging the projections from the recesses and, thus, the heald frame with and from the lifter, respectively.

Consequently, merely by lateral pivoting, for example of the lifter, the coupling device can be brought into a position permitting release of the coupling, i.e. withdrawal of the heald frame. Moving parts such as bolts, adjusting hooks, or the like, therefore become unnecessary. The actual coupling requires only two engaging moving components. This is a simple way of enabling robots to be used in that the heald frame or a complete group of frames can be changed, for example, by means of overhead grippers.

In one embodiment, a heald frame is coupled to a pair of lifters which, in turn, are actuated by a shedding motion. In addition, a cranked lever connects each lifter to the shedding motion while the heald frame is received in and guided by a pair of lateral guides. In this embodiment, at least one lateral guide is movable transversely of the heald frame for pivoting the lifters on the cranked levers in order to pivot the respective coupling sleeves and coupling members relative to each other. In this case, the cranked levers are held in a stationary position by the shedding motion, for example in a top dead center position.

In another embodiment, the cranked levers can be pivoted into positions to lift the heald frame while pivoting the lifters so as to pivot the coupling sleeve and coupling member relative to each other.

In another embodiment, the shedding motion can be connected to a control means which in turn is connected to a robot gripper which can be actuated in dependence on the shedding motion in order to raise or lower a heald frame for coupling or uncoupling purposes.

These and other objects and advantages of the invention will become more apparent from the following detailed description taken in conjunction with the accompanying drawings wherein:

FIG. 1 illustrates a diagrammatic front view of a loom incorporating a coupling device in accordance with the invention;

FIG. 2*a* illustrates a partly cross sectional view of a coupling device taken in the direction indicated by the arrow IIa of FIG. 1;

FIG. 2*b* illustrates a view taken on line IIb—IIb of FIG. 2*a;*

Figure 6A:
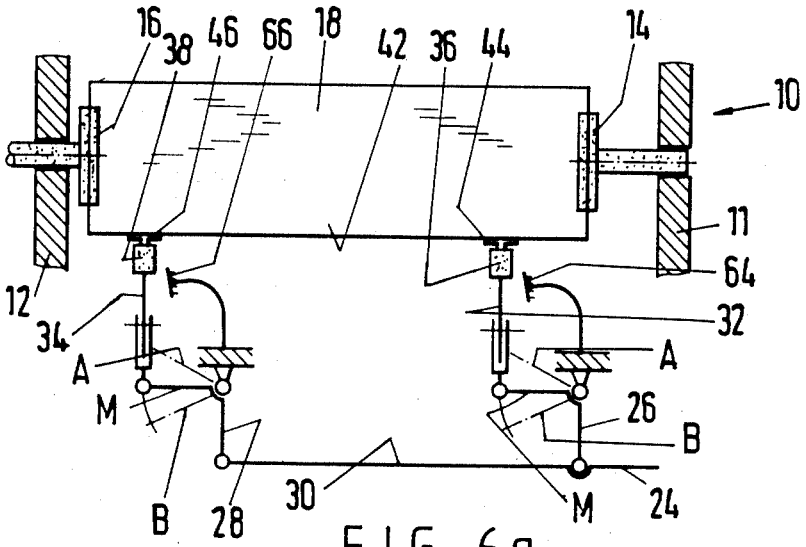
Figure 6B:
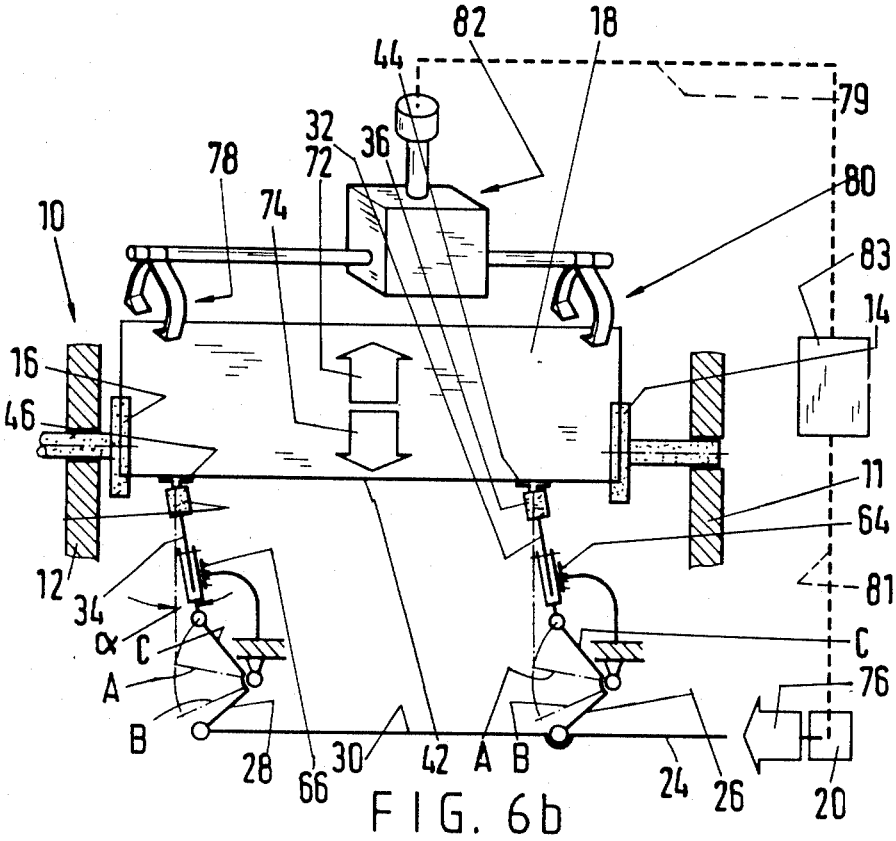
Figure 7A:
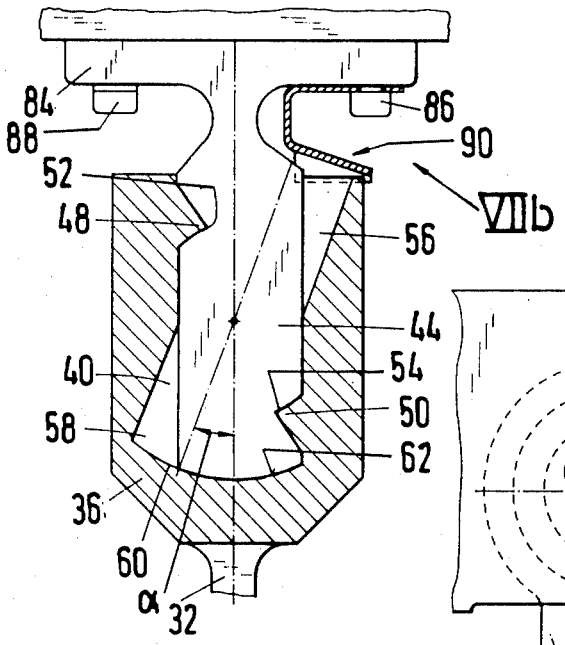
Figure 7B:
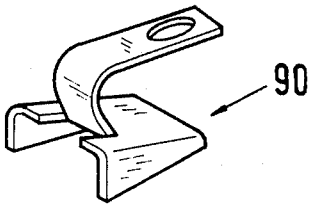
Figure 8:
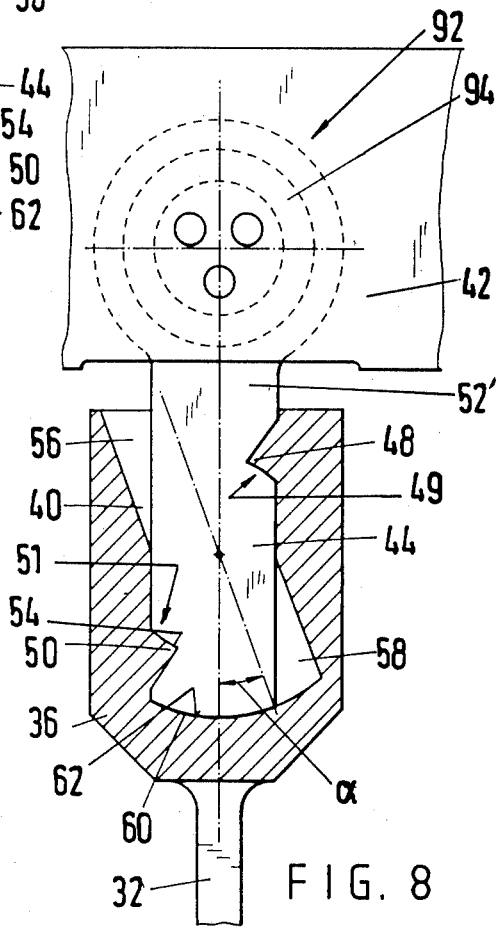

FIG. 3*a* illustrates a diagrammatic view of a loom having a movable lateral guide for moving of a heald frame in accordance with the invention;

FIG. 3*b* illustrates a perspective view of a stop for limiting pivoting movement of a lifter in accordance with the invention;

FIG. 3*c* illustrates a view similar to FIG. 3*a* with a heald frame in a displaced position for coupling or uncoupling purposes;

FIG. 4 illustrates a view similar to FIG. 2*a* of a coupling device in an uncoupled position;

FIG. 5*a* illustrates a view similar to FIG. 4 with the sleeve and member of the coupling device in a separated condition;

FIG. 6*a* illustrates a diagrammatic view of a modified loom in which a shedding mechanism is used for coupling and uncoupling the coupling device according to the invention;

FIG. 6*b* illustrates a view similar to FIG. 6*a* of a heald frame in a position ready for coupling or uncoupling in accordance with the invention;

FIG. 7*a* illustrates an enlarged view of a modified coupling device in accordance with the invention;

FIG. 7*b* illustrates a perspective view of a closing plate for closing over an uppermost widening of the coupling sleeve in accordance with the invention;

FIG. 8 illustrates a modified coupling device in accordance with the invention;

FIG. 9*a* illustrates a view similar to FIG. 2*a* of a coupling device between a lifter mechanism and a shedding motion; and FIG. 9*b* illustrates the coupling device of FIG. 9*a* in an opened condition.

Referring to FIG. 1, the loom 10 is of generally conventional structure and has a pair of side walls 11, 12 and a shedding motion 20 mounted on one side wall 11.

In addition, a pair of laterally movable guides 14, 16 is mounted on the respective side walls 11, 12 for receiving and vertically guiding heald frames 42 therein. Each heald or heddle frame 42 includes a plurality of shafts or wires 18 for warp yarns as is known.

The shedding motion includes a plurality of actuating rockers 22 which are each connected via a drive lever 24 and push or pull rods 30 to a pair of cranked levers 26, 28, each of which is pivotally mounted and actuated for actuating a respective lifter 32, 34.

Each lifter 32, 34 is in the form of a rod which is telescopically adjustable lengthwise, as is known, and is coupled by a coupling device to a heald frame 42.

Each coupling device is of identical construction. Accordingly, only one coupling device will be described for purposes of simplicity.

Referring to FIG. 2*a*, the coupling device includes a coupling sleeve 36 which has a substantially rectangular cross-section as indicated in FIG. 2*b* and which is mounted on a lifter 32 in an integral manner. In addition, the sleeve 36 has a cavity 40 which is adapted to receive a coupling member 44 which is secured to the underside of a heald frame 42. In addition, the sleeve 36 has a pair of projections 48, 50 within the cavity 40 for matingly engaging in corresponding recesses 52, 54 in the member 44 when the sleeve 36 and member 44 are in registration and engagement with one another. Still further, a pair of widenings 56, 58 are disposed within the sleeve 36 on opposite sides of the member 44 in order to permit relative pivoting of the sleeve 36 and member 44 for disengaging the projections 48, 50 from the recesses 52, 54. As indicated, each widening is of wedge-shape.

The sleeve 36 also has an arcuate shaped base 60 while the coupling member 44 has a slide surface 62 which is matingly received on the base 60 in bearing relation.

As indicated in FIG. 1, each heald frame 42 has two coupling members 44, 46 and is coupled to a pair of lifters 32, 34. The number of lifters per frame can, of course, vary. For example, in the case of very narrow looms, for example, ribbon looms, one lifter per frame is sufficient whereas in relatively wide looms, three or more lifters per frame may be provided.

As above, the lifter 34 carries a coupling sleeve 38 for coupling to the coupling member 46 on the left-hand side of the heald frame 42, as viewed.

Referring to FIGS. 3*a* and 3*c*, the cranked levers 26, 28 are each pivotally mounted for movement between a top dead center position A and a bottom dead center position B. When in a central position M, each lever corresponds to a central position of the heald frame 42. In this position, the lifters 32, 34 are vertical. In addition, a stationary stop 64, 66 is positioned to the side of each lifter 32, 34. As indicated in FIG. 3*b*, each stop 64 has a plurality of grooves 68 for receiving the respective lifters of the loom.

In order to perform an uncoupling operation, the heald frame 42 is brought into the central position indicated in FIG. 3*a*. Thereafter, the lateral guides 14, 16 are moved transversely of the frame 42 to the right as indicated by the arrow 70 over a distance L. This causes the frame 42 to pivot the lifters 32, 34 over an angle $\alpha$ while bringing each lifter into bearing engagement with a groove of a respective stop 64, 66. At this point, each coupling member 44, 46 is in a position to be readily removed from the respective coupling sleeve 36, 38 by simply lifting the frame 42 in the direction indicated by the arrow 72.

More particularly, as indicated in FIG. 4, the tooth-like projections 48, 50 of a coupling sleeve 36 are disengaged from the respective recesses 52, 54. At the same time, the arcuate base of the sleeve 36 has slid over the base 62 of the coupling member 44 and the coupling member 44 is abutted against the limits of the widenings 56, 58. In this position, the coupling member 44 can be simply raised vertically in the direction indicated by the arrows 72 to be separated from the sleeve 36, for example into a position as indicated in FIG. 5.

As indicated in FIG. 5, a new heald frame 42 can be coupled to a lifter 32 by lowering the frame 42 so that the coupling member 44 thereof moves vertically into the cavity 40 as indicated by the direction of the arrow 74. After bottoming of the coupling member 44 on the base 60 of the sleeve 36, the heald frame 42 can be shifted to the left, as viewed in FIG. 3*c*, into the position indicated in FIG. 3*a* to again effect coupling.

Referring to FIGS. 6*a* and 6*b* wherein like reference characters indicate like parts as above, each crank lever 26, 28 may be actuated by the shedding position 20 so as to be movable into a position C to lift the heald frame 42 while pivoting the lifters 32, 34 into the position illustrated in FIG. 6*b*. In this case, the lateral guides 14, 16 are not moved laterally. For example, when the shedding motion 20 causes the rods 24, 30 to move in the direction indicated by the arrow 76, each lever 26, 28 can be brought into the uppermost position C causing each lifters 32, 34 to pivot about the connecting members 44, 46 over an angle $\alpha$. As above, each lifter 32, 34 is abutted against the respective stationary stop 64, 66. At the same time, each coupling sleeve 36, 38 is pivoted relative to a connecting member 44, 46 in a counterclockwise manner as viewed in FIG. 6*b*. To this end, the respective sleeve and coupling member are arranged to permit this pivoting, for example, in the manner as indicated in FIG. 7*a*.

By only moving the levers 26, 28 to effect coupling and uncoupling, the operation of the coupling device is simplified. This is particularly suitable for a fully automatic changing of the heald frames, for example via the use of robot grippers 78, 80. In this respect, as illustrated, the robot grippers 78, 80 are actuated by a hydraulic or pneumatic pivoting drive 82 which is connected by way of a signal line 79 to a control facility 83 which, in turn, is connected by a signal line 81 to the shedding motion 20. In this way, the robot grippers 78, 80 can be moved in dependence upon the shedding motion 20.

Referring to FIG. 7*a*, wherein like reference characters indicate like parts as above, the connecting member 44 has a flange 84 which can be secured by screws 86, 88 to the underside of a heald frame 42. In addition, a resilient closing plate 90 is secured to one screw 86 so as to close over the uppermost widening 56 when the member 44 is engaged in the sleeve 36. In this way, the closing plate 90 serves to keep out fluff which might otherwise accumulate in the widening 56 and impair the pivoting movement between the member 44 and the sleeve 36. Being resilient, the plate 90 does not impair the pivoting movement.

As indicated in FIG. 7*a*, the range of pivoting of the connecting member 44 relative to the sleeve 36 is indicated by the angle $\alpha$.

Referring to FIG. 8, wherein like reference characters indicate like parts as above, the connecting member 44 may be secured by way of a known resilient torsion coupling 92 to a rubber sleeve 94 in the frame 42. This provides the advantage of a ready engagement without the need to observe very close tolerance limits with respect to the axes of the sleeve 36 and member 44 being parallel to one another.

Further, as indicated in FIG. 8, the lower flank 49 of the upper tooth-like projection 48 and the upper flank 51 of the lower projection 50 are curved for engaging in the respective recess 52, 54 in wedge-like clamping relation.

Referring to FIGS. 9*a* and 9*b*, wherein like reference characters indicate like parts as above, the coupling device may be connected between a drive lever 24 of the lifter mechanism and an actuating rocker 22 of the shedding motion 20. As illustrated the coupling sleeve 36 is integrally formed with an actuating rocker 22 while the coupling member 44 is integrally connected with the drive lever 24. As indicated in FIG. 9*b*, in order to effect an uncoupling, the coupling device is "lifted" in an upward direction such that the coupling member 44 can be moved out of the coupling sleeve 36.

The invention thus provides a relatively simple coupling device which not only provides a reliable connection between a heald frame and a lifter but also a device which can be rapidly coupled and uncoupled to permit placement or replacement of a heald frame.

What is claimed is:

1. In combination a heald frame;

at least one lifter for raising and lowering said heald frame;

a shedding motion for actuating said lifter to raise and lower said heald frame; and a coupling device releaseably connecting said lifter to said heald frame, said coupling device including a coupling sleeve secured to one of said lifter and said frame, a coupling member disposed within said sleeve and secured to the other of said lifter and said frame, at least one projection on one of said sleeve and said member and at least one recess in the other of said sleeve and said member receiving said projection, and a pair of widenings in said sleeve on opposite ends of said member to permit relative pivoting of said sleeve and said member for dis-engaging said projection from said recess and said heald frame from said lifter.

2. The combination as set forth in claim 1 wherein each of said coupling sleeve and said coupling member is of rectangular cross-section and each widening is wedge-shaped.

3. The combination as set forth in claim 2 wherein said coupling sleeve has an arcuate-shaped base and said coupling member has a slide surface matingly received on said base.

4. The combination as set forth in claim 1 which further comprises a pair of lateral guides receiving said heald frame therebetween for guiding therein and at least one cranked lever connecting said shedding motion to said lifter.

5. The combination as set forth in claim 4 wherein at least one lateral guide is movably transversely of said heald frame for pivoting said lifter on said cranked lever to pivot said coupling sleeve and said coupling member relative to each other.

6. The combination as set forth in claim 4 wherein said cranked lever is pivotal into a position to lift said heald frame while pivoting said lifters to pivot said coupling sleeve and said coupling member relative to each other.

7. The combination as set forth in claim 6 which further comprises at least one robot gripper for engaging and lifting said heald frame and a control means connected to and between said robot gripper and said shedding motion for moving said robot gripper in dependence on said shedding motion.

8. The combination as set forth in claim 1 which further comprises a stationary stop spaced from said lifter to limit pivoting of said lifter.

9. The combination as set forth in claim 8 wherein said stop has at least one groove for receiving a respective lifter.

10. The combination as set forth in claim 1 which further comprises a closing plate for closing over an uppermost one of said widenings with said member engaged in said sleeve.

11. The combination as set forth in claim 1 wherein said projection has at least one curved flank for engaging in said recess in wedge-like clamping relation.

12. A coupling device for coupling a heald frame to a lifter for raising and lowering the heald frame; said device comprising a coupling sleeve;

a coupling member disposed within said sleeve;

at least one projection on one of said sleeve and said member;

a recess in the other of said sleeve and said member receiving said projection; and a pair of widenings in said sleeve on opposite ends of said member to permit relative pivoting of said sleeve and said member for dis-engaging said projection from said recess and said heald frame from said lifter.

13. A coupling device as set forth in claim 12 wherein said coupling sleeve has an arcuate-shaped base and said coupling member has a slide surface matingly received on said base.

14. A coupling device as set forth in claim 12 which further comprises a closing plate for closing over an uppermost one of said widenings with said member engaged in said sleeve.

15. A coupling device as set forth in claim 12 wherein said projection has at least one curved flank for engaging in said recess in wedge-like clamping relation.

16. A coupling device for coupling a heald frame with a lifter mechanism for raising and lowering the heald frame to a shedding motion; said device comprising a coupling sleeve;

a coupling member disposed within said sleeve;

at least one projection on one of said sleeve and said member;

a recess in the other of said sleeve and said member receiving said projection; and a pair of widenings in said sleeve on opposite ends of said member to permit relative pivoting of said sleeve and said member for dis-engaging said projection from said recess and said lifter mechanism from said shedding motion.

17. In combination a heald frame;

a lifter mechanism including at least one lifter for raising and lowering said heald frame and a drive lever for actuating said lifter;

a shedding motion for actuating said lifter mechanism to raise and lower said heald frame; and a coupling device including a coupling sleeve secured to one of said drive lever and said shedding motion, a coupling member disposed within said sleeve and secured to the other of said drive lever and said shedding motion, at least one projection on one of said sleeve and said member and at least one recess in the other of said sleeve and said member receiving said projection, and a pair of widenings in said sleeve on opposite ends of said member to permit relative pivoting of said sleeve and said member for dis-engaging said projection from said recess and said lifter mechanism from said shedding motion.

18. The combination as set forth in claim 17 wherein each of said coupling sleeve and said coupling member is of rectangular cross-section and each widening is wedge-shaped.

19. The combination as set forth in claim 18 wherein said coupling sleeve has an arcuate-shaped base and said coupling member has a slide surface matingly received on said base.

* * * * *